US006254649B1

(12) United States Patent
Sherman et al.

(10) Patent No.: US 6,254,649 B1
(45) Date of Patent: Jul. 3, 2001

(54) BODY BOARD

(75) Inventors: Robyn Ann Sherman; Bryan L. Larkin, both of Batehaven; Kenneth John Gordon, Benowa, all of (AU)

(73) Assignee: Stealth Boards Pty Ltd., Southport (AU)

( * ) Notice: Subject to any disclaimer, the term of this patent is extended or adjusted under 35 U.S.C. 154(b) by 0 days.

(21) Appl. No.: 09/623,723

(22) PCT Filed: Dec. 18, 1998

(86) PCT No.: PCT/AU98/01051

§ 371 Date: Oct. 10, 2000

§ 102(e) Date: Oct. 10, 2000

(87) PCT Pub. No.: WO99/32353

PCT Pub. Date: Jul. 1, 1999

(30) Foreign Application Priority Data

| | | |
|---|---|---|
| Dec. 18, 1997 | (AU) | PP1000 |
| Apr. 23, 1998 | (AU) | PP3131 |
| Jul. 30, 1998 | (AU) | PP4934 |

(51) Int. Cl.[7] ..... B63B 35/00
(52) U.S. Cl. ..... 44/65; 441/74; 441/79
(58) Field of Search ..... 441/65, 68, 74, 441/75, 126

(56) References Cited

U.S. PATENT DOCUMENTS

| | | | | |
|---|---|---|---|---|
| 4,752,262 | * | 6/1988 | Martinmaas | 441/79 |
| 4,883,436 | * | 11/1989 | Oakland | 441/79 |
| 4,886,476 | | 12/1989 | Brocone et al. . | |
| 5,389,023 | | 2/1995 | McIntyre . | |

FOREIGN PATENT DOCUMENTS

| | | |
|---|---|---|
| 41216/78 | 5/1980 | (AU) . |
| 34251/95 | 5/1996 | (AU) . |
| 2 516 472 | 5/1983 | (FR) . |

* cited by examiner

*Primary Examiner*—Jesus D. Sotelo
(74) *Attorney, Agent, or Firm*—Merchant & Gould P.C.

(57) ABSTRACT

A body board (10) having a pair of side rails (13, 14), the body board (10) including a fin (20) that extends laterally from at least one side rail (14) of the body board (10).

21 Claims, 2 Drawing Sheets

BODY BOARD

FIELD OF THE INVENTION

This invention relates to a body board and, in particular, relates to maintaining stability of a body board when riding a wave.

BACKGROUND OF THE INVENTION

Body boards are typically constructed from an expanded closed-cell foam. The body board has a top skin on which riders lay and, a bottom, smooth skin which contacts the wave when riding the body board. A pair of side rails extend between the top skin and bottom skin along a major portion of the perimeter of the body board.

When riding a wave, the object of most riders is to cut across a face of the wave to obtain a long ride and to perform tricks such as spinning the board through 360°. To enable the body board to travel across the face of the wave, a rider must lean to one side of the body board to dig one of the rails into the face of the wave.

In particular wave conditions, or through a riders lack of experience, or rider error, the rail is often not dug into the face of the wave. This can cause the body board and rider to slide down the face of the wave usually causing a "wipeout".

To prevent a body board from sliding down the face of the wave, downwardly extending fins are attached to the bottom skin of the body board. The fins work well in enabling a rider to guide the body board across the face of the wave without slippage of the body board down the face of the wave.

However, the fins often prevent tricks being performed that involve quick rotation of the body board. Further, the fins can cause injury to swimmers or other riders if run over by the body board. Hence, fins that extend downwardly from the bottom skin are undesirable and therefore are not in common use by riders.

SUMMARY OF THE INVENTION

It is an object of this invention to overcome or alleviate some of the above disadvantages or provide the consumer with a useful or commercial choice.

In one form the invention resides in a body board having a pair of side rails, the body board including one or more fins that extend laterally from at least one side rail of the body board.

The body board may be made from any suitable material such as a closed-celled foam. The body board may have all or some of the features of standard body boards.

The fin may be made from any suitable material. Typically the fin is constructed from inflexible materials such as hard plastics.

Typically there is a fin mounted to each side rail of the body board. The fins may be fixed relative to the side rails. However, preferably the fins are able to be extended or retracted with respect to the side rails.

When the fins are able to be extended or retracted, typically they are movable from within a respective housing. The housings may be formed from an inflexible material and may be located within the side rails of the body board. The housings may assist in preventing flexing of the body board. The fins may be pivotally mounted within the housings.

In one embodiment, a connecting rod may be attached to each fin to extend or retract the fins. A biasing means such as a spring may form part of the connecting rod such that when the fin is bumped, the fin can move slightly inwardly or outwardly to protect the fins from damage.

A control means may be used to control the movement of the connecting rods. The control means may be of any suitable form.

The control means may comprises a pawl that operates two parallel, spaced ratchets. Rotation of the pawl may cause opposite longitudinal movement of each of the ratchets with respect to each other. Each ratchet may be connected to a connecting rod to extend or retract the fin.

Alternatively, the control means may be a shaft that has a T-head. Each end of the T-head may be attached to a connecting rod such that upon rotation of the shaft, the connecting rods extend or retract the fins.

Still alternatively, the control means may be a shaft connected to a cam. The connecting rods may be biassed to retract the fins so that upon rotation of the shaft, the cam pushes the connecting rods outwardly to extend the fins.

The control means and connecting rods are preferably hidden within the body board.

The control means may be operated by an externally mounted control handle or knob or the like. Alternately, a removable key or spine may be used to operate the control means.

In a second embodiment, each fin may be moved independently of each other. Each of the fins may be biased outwardly from their respective housings. A helical spring, a leaf spring, a resilient block or the like biasing means can be used to bias the fins outwardly.

Guides may be provided within the housing to guide movement of the fin within the housing. A stop may be provided on the housing or on the fin to stop the fin from being extended beyond a desired position within the housing.

A retaining means may be provided within the housing to retain the fin within the housing. The retaining means may allow the fin to be extended to a plurality of discrete positions relative to the housing. The retaining means may be a catch or latch or the like device. The catch or latch may be biased toward a retaining position and may be moved to a extension position to allow the fin to be extended.

The fin may have at least one holding means for engagement with the retaining means. The holding means may be a stepped portion, land or aperture.

BRIEF DESCRIPTION OF THE DRAWINGS

Embodiments of the invention will be described with reference to the accompanying drawings in which.

DETAILED DESCRIPTION OF THE PREFERRED EMBODIMENTS

Figure 1:
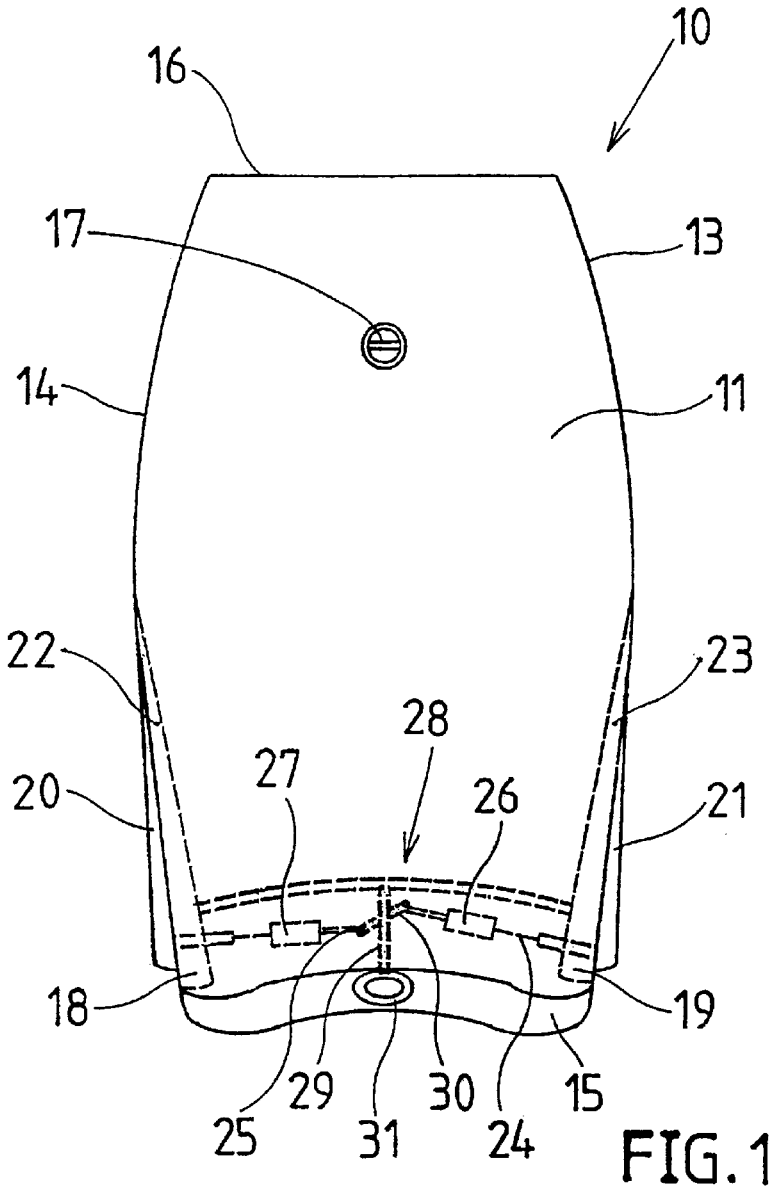
FIG. 1 is a plan view of a body board according to one embodiment of the invention.
Figure 2:
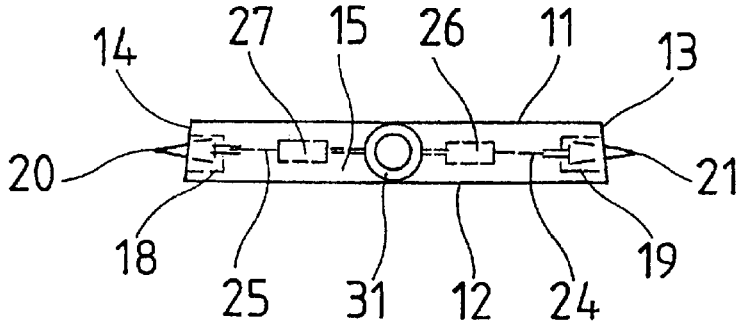
FIG. 2 is an end view of the body board of FIG. 1.

FIGS. 1 and 2 show a body board 10 with a core formed from a closed-cell foam. The body board 10 has a top skin 11 on which a rider lies and a bottom skin 12, made from a smooth material, which contacts a wave when the body board 10 is in use. A pair of side rails 13 and 14 and end rail 15 separate the top skin 11 and the bottom skin 12 along a major portion of the perimeter of the body board 10. A nose 16 is formed at the front of the body board 10 where the top skin 11 and bottom skin 12 are joined. An arm rope attachment device 17 extends through and is located on an upper portion of the body board 10.

Two housings 18 and 19 are located within the side rails 13 and 14. The housings 18 and 19 are made of a rigid plastics which assists in preventing flexing of the body board 10 when riding the wave. This enhances the body board's performance and also the body board's life as the core is not compressed due to flexing.

Two fins 20 and 21 are pivotally mounted via respective pins 22 and 23 within the housings 18 and 19. Connecting rods 24 and 25 are attached to respective fins 18 and 19 with springs 26 and 27 forming part of the connecting rods. The springs 26 and 27 allow slight inward and outward movement of the fins 18 and 19 if the fins are knocked against an object. This protects both the fins 18 and 19 and the object from damage.

A control mechanism 28 controls the movement of the connecting rods 24 and 25 and is located within the core of the body board 10. The control mechanism 28 comprises a shaft 29 having a T-head 30. Each end of the T-head 30 is connected to a respective end of the connecting rods 24 and 25. The connecting rods 24 and 25 are fully retracted when the T-head 30 is in a position substantially parallel to the side rails 13 and 14 and fully extended when the T-head 30 is in a position substantially perpendicular to the side rails 13 and 14.

A control knob 31 is connected to the opposite end of the shaft 29 to the end having the T-head 30. The control knob 31 is located external to the body board 10 adjacent the end rail 15.

To retract or extend the fins 20 and 21, the control knob 31 is rotated which causes simultaneously rotation of the shaft 29 and T-head 30. This causes the connecting rods 24 and 25 to extend or retract which in turn retracts or extends the fins 20 and 21.

The side fins 20 and 21 prevent the body board 10 from slipping down a face of the wave. The side fins 20 and 21 can be extended in small wave conditions to decrease the speed of the body board 10 across the wave and retracted in big wave conditions to increase the speed of the body board 10 across the wave. Retraction and extension of the fins 20 and 21 can increase the length of the ride and improve the performance of the body board 10. Spinning tricks can also be performed easily with little or no interference from the fins 20 and 21.

Figure 3:
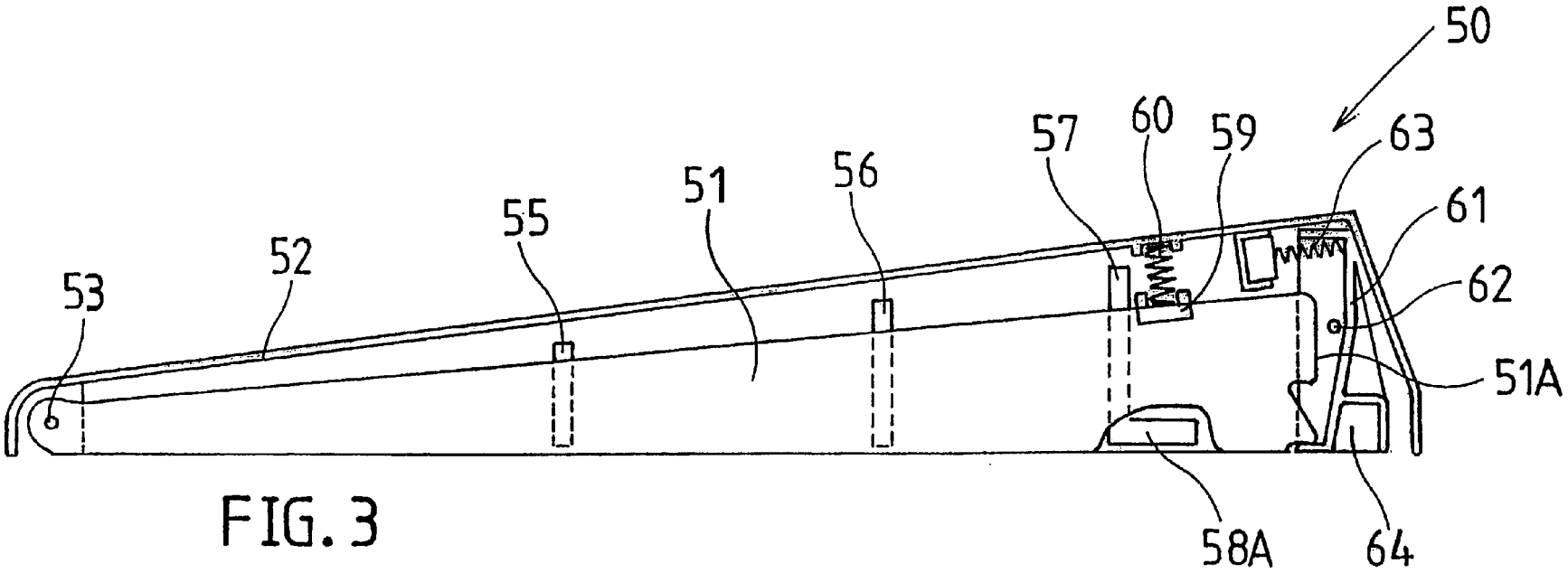
FIG. 3 is a sectional plan view of a fin unit mountable within a body board according to a second embodiment of the invention.
Figure 4:
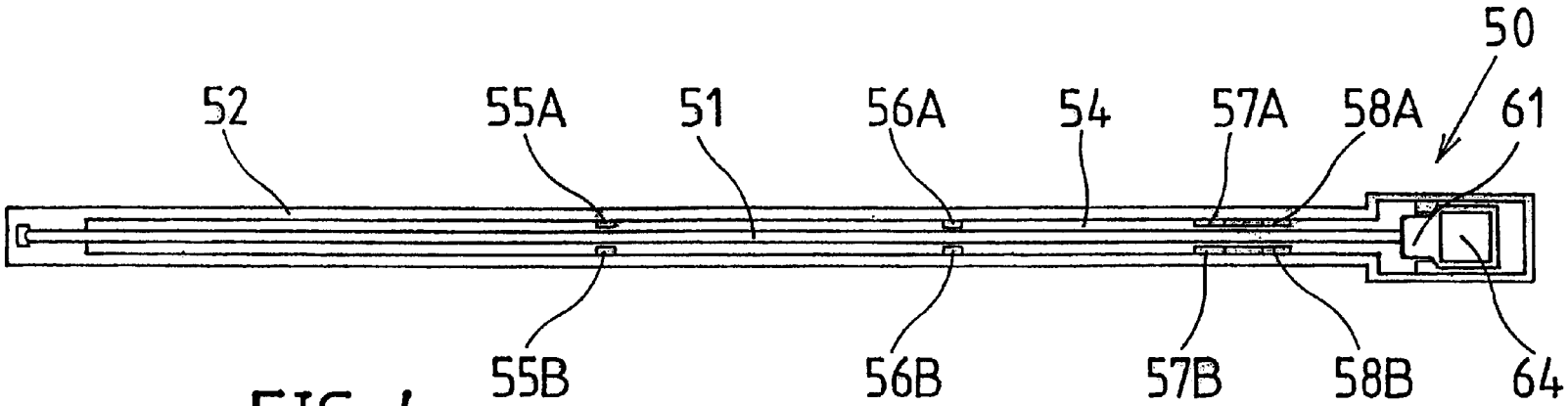
FIG. 4 is an end view of a fin unit mountable within a body board according to FIG. 3.

FIG. 3 and 4 show a fin unit 50 that is able to be mounted within a side rail of a body board. The fin unit comprises a fin 51 located within a housing 52. A pin 53 is used to pivotally mount the fin 51 within the housing 52.

The housing 52 is elongate and constructed from rigid plastics. A channel 54 is located within the housing 52 to allow the fin 51 to be totally retracted within the housing 52.

Three sets of guides 55, 56 and 57 are located within the housing 52 to guide movement of the fin 51 within the housing 52. Each set of guides 55, 56 and 57 has two guides 55A and 55B, 56A and 56B, and 57A and 57B located on opposite sides of the fin 51 to space the fin 51 from the housing 52. This allows any sand that becomes lodged within the housing 52 to be easily dislodged, preventing jamming of the fin 51 within the housing 52.

Stops 58A and 58B are located on the first set of guides 55. Corresponding stop members 59 are located on each side of fin 51 to engage with the stops 58A and 58B. This prevents the fin 51 being extend past a desired position from within the housing 52.

The fin 51 is biased outwardly from the housing by a spring 60 and is retained in a retracted position by a catch 61. The catch 61 is pivotally mounted within the housing 52 by a pin 62 and is biased toward the fin by a spring 63. The catch 61 can be retracted via a finger hole 64 to release the fin 51 to an extended position.

An edge 51A of the fin 51 is stepped so that the catch can engage the fin 51 at different locations along the edge 51A. This allows the fin 51 to be extended and held at discrete positions depending upon wave conditions.

The fin 51 is retracted within the housing 52 by pushing the fin 51 inwardly. This also prevents the fin 51 being damaged if knocked against an object as it will automatically retract.

It should be appreciated that various other changes and modifications may be made to the embodiment described without departing from the spirit or scope of the invention.

What is claimed is:

1. A body board having a pair of side rails, the body board including one or more fins that extend laterally from at least one side rail of the body board wherein the one or more fins is or are able to be extended or retracted with respect to the side rails.

2. The body board of claim 1 wherein at least two of said fins extend laterally, each from a respective side rail of the body board.

3. The body board of claim 1 wherein each fin is retracted or extended from within a housing which is located within the side rails.

4. The body board of claim 3 wherein each fin is pivotally mounted within the respective housing.

5. The body board of claim 1 wherein each fin is able to be moved independently of the other fin.

6. The body board of claim 1 wherein each fin is biased to extend from the housing.

7. The body board of claim 3 wherein a retaining means is provided within each housing to retain the fin within the housing.

8. The body board of claim 7 wherein the retaining means allows the fin to be extended to a plurality of positions relative to the housing.

9. The body board of claim 8 wherein the retaining means is a catch.

10. The body board of claim 3 wherein a stop is provided on the housing or the fin to prevent extension of the fin beyond a desired position from the housing.

11. The body board of claim 3 wherein a number of guides are located within the housing to guide movement of the fin within the housing.

12. The body board of claim 1 wherein a connecting rod is connected to each fin to extend or retract the fins.

13. The body board of claim 12 wherein a biasing means forms part of the connecting rod.

14. The body board of claim 12 wherein a control means is connected to the connecting rod to control the movement of the connecting rod.

15. The body board of claim 14 wherein the control means is a pawl that operates two spaced apart ratchets that are connected the connecting rods.

16. The body board of claim 14 wherein the control means is a shaft having a T-head, the ends of the T-head attached to respective connecting rods.

17. The body board of claim 14 wherein the control means is a shaft connected to a cam, the cam able to contact the connecting rods to move the connecting rods.

18. The body board of claim 14 wherein control means and connecting rod are hidden within the body board and a fin is mounted to each side rail of the body board.

19. The body board of claim 18 wherein an externally mounted control handle is used to operate the control means.

20. The body board of claim 18 wherein a removable key is used to operate the control means.

21. A body board including a pair of side rails, the body board including one or more pivotally mounted fins that are extendable and retractable from within a housing, the housing located within a body board such that the fins can extend laterally from at least one side rail of the body board, retaining means to keep each fin retracted within the housing, a stop to prevent each fin from extending beyond a desired position from the housing, and guides located within the housing to guide movement of the fin within the housing.

* * * * *